US006581222B1

(12) United States Patent
Liljedahl

(10) Patent No.: US 6,581,222 B1
(45) Date of Patent: Jun. 24, 2003

(54) LIFTING SLING

(75) Inventor: Gunnar Liljedahl, Luleå (SE)

(73) Assignee: Liko Research & Development AB, Luleå (SE)

( * ) Notice: Subject to any disclaimer, the term of this patent is extended or adjusted under 35 U.S.C. 154(b) by 0 days.

(21) Appl. No.: 10/030,131

(22) PCT Filed: May 29, 2000

(86) PCT No.: PCT/SE00/01105

§ 371 (c)(1),
(2), (4) Date: Jan. 25, 2002

(87) PCT Pub. No.: WO01/13857

PCT Pub. Date: Mar. 1, 2001

(30) Foreign Application Priority Data

Aug. 25, 1999 (SE) ..... 9902999

(51) Int. Cl.[7] ..... A61G 7/10
(52) U.S. Cl. ..... 5/89.1; 5/83.1
(58) Field of Search ..... 5/81.1 R, 83.1, 5/85.1, 86.1, 87.1, 89.1; 482/69

(56) References Cited

U.S. PATENT DOCUMENTS

| | | | | | |
|---|---|---|---|---|---|
| 2,109,188 | A | * | 2/1938 | Bejanova | 482/69 |
| 3,252,704 | A | * | 5/1966 | Wilson | 5/83.1 X |
| 3,721,436 | A | * | 3/1973 | Barthel, Jr. | 482/69 |
| 3,761,082 | A | * | 9/1973 | Barthel, Jr. | 482/69 |
| 4,903,355 | A | * | 2/1990 | Hickerson | 5/83.1 |
| 4,918,771 | A | | 4/1990 | James | 5/81 |
| 5,396,670 | A | * | 3/1995 | Firebaugh et al. | 5/89.1 |
| D366,550 | S | * | 1/1996 | Shapiro | D34/28 |
| 5,502,851 | A | * | 4/1996 | Costello | 5/86.1 |
| 5,530,975 | A | * | 7/1996 | Firebaugh et al. | 5/89.1 X |
| 6,175,973 | B1 | * | 1/2001 | Hakamiun et al. | 5/89.1 |
| 6,289,534 | B1 | * | 9/2001 | Hakamiun et al. | 5/89.1 |
| 6,449,785 | B1 | * | 9/2002 | Liljedahl | 5/89.1 |

FOREIGN PATENT DOCUMENTS

SE 511982 1/2000

OTHER PUBLICATIONS

Excerpt entitled "Molift Partner" from a brochure presented by Actuator AS, dated Oct. 8, 1993.*

* cited by examiner

*Primary Examiner*—Robert G. Santos
(74) *Attorney, Agent, or Firm*—Jacobson Holman PLLC

(57) ABSTRACT

A harness for lifting a disabled person from a sitting position to a standing position by a lifting device having two attaching points for the lifting action, there being a distance between these points. The harness including a belt at least partly surrounding the body of the person to be lifted, which belt has four bands, which can be hooked on the attaching points so that the belt surrounds the person overlapping on the breast under breast height and two of the bands crossing each other. In order to increase the lateral stability when lifting the person two other of the four bands are attached to a back piece forming a part of the harness, which back piece is extended at the rear of the back of the person and outside the shoulders.

3 Claims, 2 Drawing Sheets

LIFTING SLING

This is a nationalization of PCT/SE00/01105 filed May 29, 2000 and published in English.

This invention relates to a lifting sling or lifting harness to be used for raising a disabled person from a sitting position to a standing position by means of a lifting device, which lifting device has two attaching points, there being a distance between the two paints, which corresponds to the breadth across the shoulders of a person to be lifted, each attaching point having a hook, on which a belt can be hooked via four bands attached to the belt in such a way that the belt surrounds the person overlapping on the breast under breastheight, whereat the bands consist of two straps, which cross each other on the breast and thereafter each strap passes through one ring means fastened to the belt and further consists of two lifting bands, each of which are fixed to the belt on a place, which corresponds to the chestside of the person, whereby the person is lifted by the lifting device with the point of application situated on the person's breast by that one strap and one lifting band is hooked on each hook.

A lifting harness or lifting sling of this kind is known from e.g. SE patent application 9900895-5. The object of the invention is to increase the lateral stability for the person when being in the critical break between the sitting position and the standing position. This object is achieved by the invention as it is stated in the enclosed claims An embodiment of the invention will be described in the following by reference to the enclosed drawings.

Figure 1:
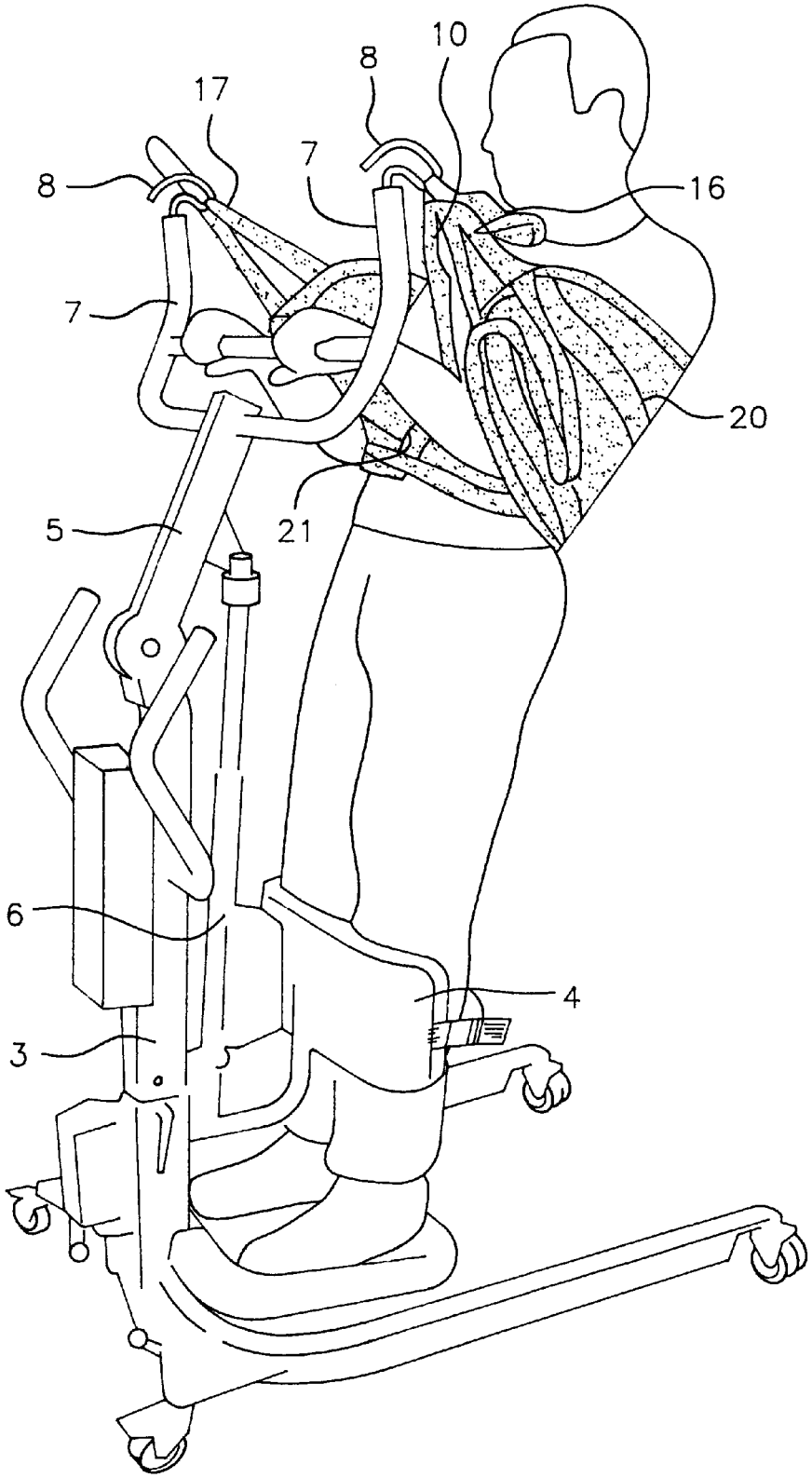
FIG. 1 is thereby a perspective view of the sling or the harness according to the invention, in which the person to be lifted is in a half-standing position.

FIG. 1 thus shows an embodiment of the invention seen from a perspective view. The lifting device consists of a wheelbase, which supports a footplate and a post 3. The post supports in its lower part a knee support 4, which is adjustable in the direction towards or from the post 3. The post supports in its upper part a swinging arm 5, which swings upwards and downwards in a vertical plane by means of an electric or hydraulic driving means 6. The swinging arm has an extension from its free end in the form of two arms 7, which are extended parallel to each other having a certain distance between themselves, which distance preferably is similar to the breadth across the shoulders of the person being lifted. Each end of the arms 7 has a hook 8 for attaching a lifting sling 16, 17, which is stretched from a back piece 20.

Figure 2:
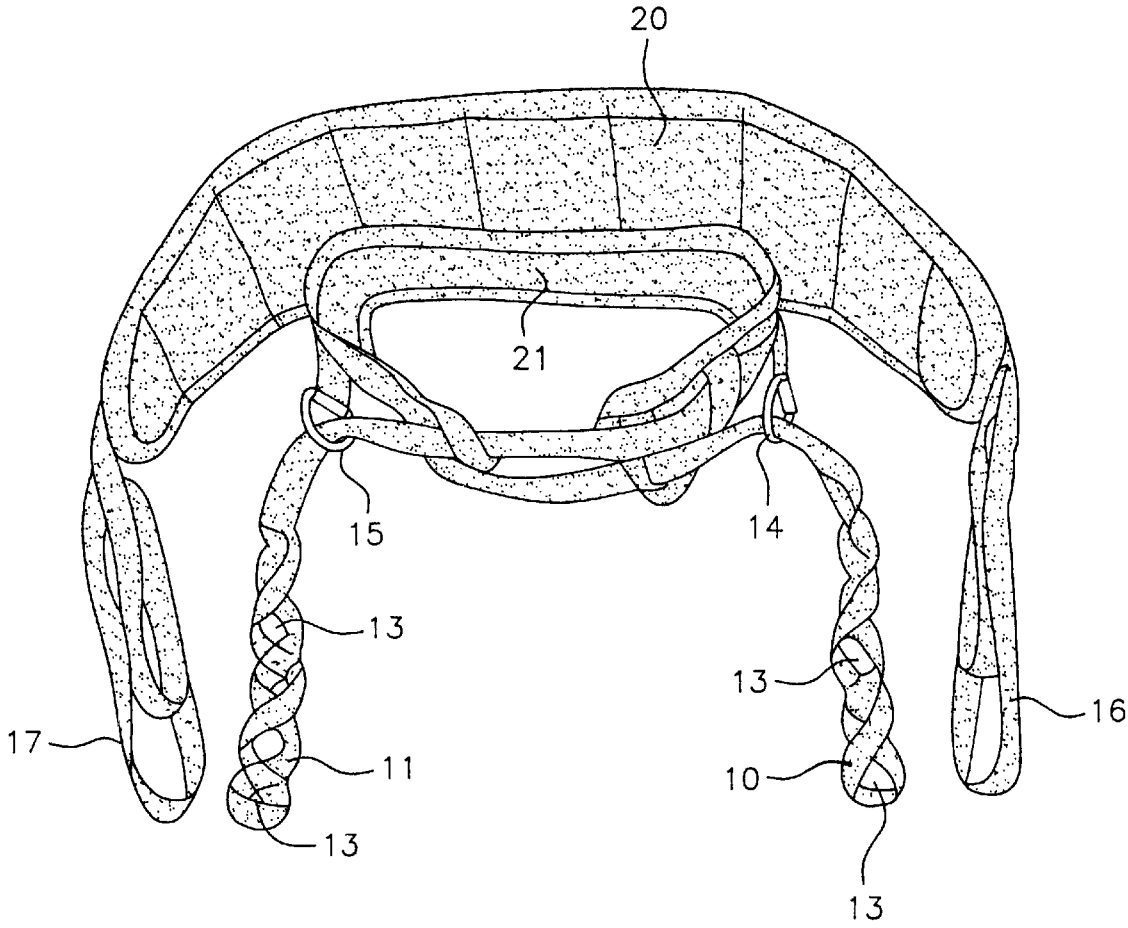
FIG. 2 is a perspective view of the lifting sling or lifting harness according to the invention.

As known before a strap 10 is extended from the right side of belt 21 (=right side of the person) and a second strap 11 is extended from the left side of the belt. These straps have a number of loops 13 at the end of the straps in order to present different points of attachment on the hooks 8. When the belt 21 is used for lifting a person it is surrounded the body of the person at breast height from the back of the person. Thus the belt is extended around the body, whereafter the straps 10 and 11 of the belt 21 each is passed through rings 14 and 15 respectively. Thus, the strap 10 is passed through the ring 14 when the belt is surrounded the body of the person and the strap 11 is passed through the ring 15. When the straps 10 and 11 are tightened the belt will be tightened around the body of the person. The rings 14 and 15 are attached at points of the belt, which are closer to the free ends of the belt than to the middle of the belt. See hereby also FIG. 2, from which can be seen that the strap 10 is extended from the backside of the belt through the ring 15 and the strap 11 is extended through the ring 14 so that the two strap are crossing each other.

As mentioned above the belt has two lifting bands 16 and 17, which are attached to the belt at the back piece 20. The back piece 20 is attached to the back surface of the belt 21 and the two free ends of the back piece 20 are extended outside the shoulder and forwards outside the upper part of the arms a certain distance. Two lifting bands 16 and 17 respectively are each extended from each end of the back piece 20. The lifting bands 16 and 17 are each in the form of a sling, which can be hooked on a corresponding hook 8.

When the person is to be lifted from a sitting position e.g. from a chair not shown in FIG. 1, the belt is placed around the body of the person just under breast height and overlapping in the way shown in FIG. 1. The straps 10 and 11 are thereafter hooked on the belonging hook 8 in a way so that the straps are comfortably stretched by using any of loops 13 arranged on each strap. The lifting bands 17 and 18 are thereafter hooked in the same way. After this it is checked that all straps and bands are equally stretched. In dependance of the size of the person in breast height the straps 10 and 11 will have different free lengths. If the person is large, a shorter length of the straps 10 and 11 will be available from the ring 14 and 15 respectively for being hooked on the hook. The straps and the lifting bands should preferably be equally stretched after being hooked on the hooks 8.

If for instance the two straps 10 and 11 are too slack, they must be hooked in a loop 13, which is situated further in on the strap. An ideal arrangement could be that when the straps are tightened to a certain degree the belt will be fixed around the body without inconvenience and that thereafter the lifting action is carried out only with the lifting bands 17 and 18. By that the straps are fixed in the hooks 8 the decided tension in the straps will be maintained during the lifting action. The inner face of the end parts of the back piece 20 will contact against the shoulder and the outsides of the upper arm parts while the belt 21 surrounds the chest. A good stability will hereby be achieved. An embodiment of the invention has thus been described above. Within the inventive idea there are several embodiments concerning the design of the back piece and the attachment of the lifting slings to the back piece. The lifting slings can be simple having eyes instead of being a sling.

What is claimed is:

1. A lifting sling to be used for raising a disabled person from a sitting position to a standing position by means of a lifting device, wherein said lifting device has two attaching points for providing a lifting action such that a distance between the two points corresponds to the breadth across the shoulders of a person to be lifted, each attaching point having a hook, on which said lifting sling comprising a belt can be hooked via four bands attached to the belt in such a way that the belt surrounds the person by overlapping on the breast of said person and passing under the breastheight of said person, whereat the bands consist of two straps, which cross each other on the breast and that thereafter each strap passes through one ring fastened to the belt, and further consists of two lifting bands, each of which are fixed to the belt on a place which corresponds to the chestside of the person, whereby the person can be lifted by the lifting device from a point of application situated on the person's breast such that one strap and one lifting band can be hooked on each hook, each one of the lifting bands extending from a back piece forming a part of the lifting sling, said back piece being configured to extend behind the back of the person, the back piece being configured to extend from the shoulders to the waist of the person.

2. A lifting sling to be used for raising a disabled person from a sitting position to a standing position by means of a lifting device, wherein said lifting device has two attaching points for providing a lifting action such that a distance between the two points corresponds to the breadth across the shoulders of a person to be lifted, each attaching point having a hook, on which said lifting sling comprising a belt can be hooked via four bands attached to the belt in such a way that the belt surrounds the person by overlapping on the breast of said person and passing under the breastheight of said person, whereat the bands consist of two straps, which cross each other on the breast and that thereafter each strap passes through one ring fastened to the belt, and further consists of two lifting bands, each of which are fixed to the belt on a place which corresponds to the chestside of the person, whereby the person can be lifted by the lifting device from a point of application situated on the person's breast such that one strap and one lifting band can be hooked on each hook, each one of the lifting bands extending from a back piece forming a part of the lifting sling, said back piece being configured to extend behind the back of the person, each of the lifting bands consisting of a loop attached to the back piece a mutual distance apart.

3. A lifting sling to be used for raising a disabled person from a sitting position to a standing position by means of a lifting device, wherein said lifting device has two attaching points for providing a lifting action such that a distance between the two points corresponds to the breadth across the shoulders of a person to be lifted, each attaching point having a hook, on which said lifting sling comprising a belt can be hooked via four bands attached to the belt in such a way that the belt surrounds the person by overlapping on the breast of said person and passing under the breastheight of said person, whereat the bands consist of two straps, which cross each other on the breast and that thereafter each strap passes through one ring fastened to the belt, and further consists of two lifting bands, each of which are fixed to the belt on a place which corresponds to the chestside of the person, whereby the person can be lifted by the lifting device from a point of application situated on the person's breast such that one strap and one lifting band can be hooked on each hook, one of the lifting bands extending only from a back piece forming a part of the lifting sling, said back piece being configured to extend behind and around the back of the person and being configured to extend from the shoulder to the waist of the person.

* * * * *